US006932585B2

(12) United States Patent
Na et al.

(10) Patent No.: US 6,932,585 B2
(45) Date of Patent: Aug. 23, 2005

(54) CYLINDER ASSEMBLY OF HERMETIC COMPRESSOR

(75) Inventors: Jong-young Na, Gwangju (KR); Yong-Tae Yoon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 239 days.

(21) Appl. No.: 10/390,396

(22) Filed: Mar. 18, 2003

(65) Prior Publication Data

US 2003/0194337 A1 Oct. 16, 2003

(30) Foreign Application Priority Data

Apr. 10, 2002 (KR) ..... 2002-19423

(51) Int. Cl.[7] ..... F04B 39/10
(52) U.S. Cl. ..... 417/571; 137/856
(58) Field of Search ..... 137/856; 417/559, 417/569, 571

(56) References Cited

U.S. PATENT DOCUMENTS 1,986,831 A * 1/1935 Le Valley
2,043,849 A * 6/1936 Bixler
2,109,541 A * 3/1938 Le Valley
2,908,287 A * 10/1959 Augustin
3,375,972 A * 4/1968 Raufeisen
4,723,896 A * 2/1988 Fritchman ..... 417/571
5,249,939 A * 10/1993 Takahashi ..... 417/569
5,454,397 A * 10/1995 Miszczak ..... 137/856
5,456,287 A * 10/1995 Leu ..... 417/571
5,577,901 A * 11/1996 Yoon ..... 417/571

* cited by examiner

*Primary Examiner*—Michael Koczo, Jr.
(74) *Attorney, Agent, or Firm*—Plumsea Law Group, LLC

(57) ABSTRACT

A cylinder assembly of a hermetic compressor has a valve plate disposed on an outer side of a cylinder block to cover an open side of a cylinder, the valve plate defines a refrigerant discharge hole therethrough which is adapted to discharge a compressed refrigerant from the cylinder. A cylinder head disposed to cover the outer side of the valve plate defines a refrigerant discharge chamber in cooperation with the valve plate. A discharge valve is disposed between the valve plate and the cylinder head in a cantilever fashion with a central portion thereof covering the refrigerant discharge hole. A restricting mechanism comprising a first stopper member protruding from an inner wall of the cylinder head a distance such that a terminal edge of the first stopper member is at a predetermined distance from a free end of the discharge valve for restricting movement of the discharge valve. During the opening of the refrigerant discharge hole, the discharge valve is deformed such that the central portion deformed toward said cylinder head while movement of the free end of the discharge valve limited due to the first stopper member.

13 Claims, 5 Drawing Sheets

CYLINDER ASSEMBLY OF HERMETIC COMPRESSOR

BACKGROUND OF THE INVENTION

1. Field of the Invention

The present invention generally relates to a compressor, and more particularly, it relates to a cylinder assembly of a hermetic compressor which is installed in appliances like refrigerators to compress refrigerant.

2. Description of the Prior Art

Referring to FIGS. 1 and 2, a conventional hermetic compressor 100 includes a casing 110 having a refrigerant inflow pipe 111 and a refrigerant outflow pipe (not shown) provided therein, an electronically-driven unit 120 and a cylinder assembly 130.

The electronically-driven unit 120 supplies driving force for refrigerant compression, and includes a stator 120 fixed inside of the casing 110, a rotor rotating in the stator 121 and having a rotary shaft 125 force fit therein, an eccentric unit 127 eccentrically connected to one end of the rotary shaft 125, and a piston 129 connected to a side of the eccentric unit 127.

The cylinder assembly 130 is provided to compress refrigerant flowing into the compressor 100, and includes a cylinder block 131 having a cylinder 133, i.e., a space for permitting reciprocal movement of the piston 129, formed therein, a cylinder head 135 formed on an open side of the cylinder block 131 to seal the cylinder 133, a valve plate 137 disposed between the cylinder block 131 and the cylinder head 135, and a cylinder gasket 136.

The cylinder head 135 has a partition 135*c* formed therein, which defines a space between the valve plate 137 and the cylinder head 135 into a refrigerant suction chamber 135*a* and a refrigerant discharge chamber 135*b*. The refrigerant suction chamber 135*a* temporarily reserves the refrigerant which is flowing to the cylinder 133 through the refrigerant inflow pipe 111, and the refrigerant discharge chamber 135*b* temporarily accommodates the refrigerant compressed by the cylinder 133.

The valve plate 137 includes a refrigerant suction hole 137*a* for interconnecting the cylinder 133 and the refrigerant suction chamber 135*a*, and a refrigerant discharge hole 137*c* for interconnecting the cylinder 133 and the refrigerant discharge chamber 135*b*.

The refrigerant suction hole 137*a* is opened and closed by a resilient movement of the suction valve 134*a* that is moved by the flow of refrigerant. The suction valve 134*a* is formed by cutting off a part of a suction valve sheet 134 disposed in between the cylinder block 131 and the valve plate 137.

As shown in FIG. 3, the refrigerant discharge hole 137*c* is opened and closed by the resilient movement of the discharge valve 139*a* that is moved by the flow of refrigerant. The discharge valve 139*a* is formed on a side of the valve plate 137 that is exposed to the refrigerant discharge chamber 135*b*, in a manner of covering the refrigerant discharge hole 137*c*. With one end being secured to the valve plate 137 by a fastening means S such as a rivet, the discharge valve is formed on the valve plate 137 in a cantilever pattern. The free end of the valve plate 137 covers the refrigerant discharge hole 137*c*. The valve plate 137 has a stopper member 139*b* and a keeper plate 139*c* for covering the discharge valve 139, so as to restrict the movement of the discharge valve 139*a* during refrigerant discharge.

In the conventional hermetic compressor 100 constructed as above, the discharge valve 139*a*, the stopper member 139*b*, and the keeper plate 139*c* have to be separately formed and then assembled onto valve plate 137. Accordingly, a number of parts and complication increases for the manufacturing of the compressors.

Further, as the discharge valve 139*a* is made of a resilient material and formed in a cantilever pattern, the free end of the discharge valve 139*a*, which is more apt to be moved than the other parts, usually beats the stopper member 139*b* and the valve plate 137 during the suctioning/discharging of the refrigerant, resulting in considerable level of noise and vibration. Such generated noise and vibration are further worsened during the movement of the discharge valve 139*a* due to vibration of the free end. Accordingly, the compressor 100 is operated with a considerable noise, and when used for a long time, the compressor 100 has a problem of deteriorated durability due to vibration resulting in fatigue failures such as a crack in the fastening means S or the like.

Further, since the discharge valve 139*a* is connected to the valve plate 137 by the separate fastening means S, it is possible that the fixed ends of the valve plate 137 and the discharge valve 139*a* are pressed to each other inaccurately due to manufacturing errors, or the like. When this happens, as the refrigerant discharge hole 137*c* is incompletely sealed by the discharge valve 139*a*, a so-called 'back flow' phenomenon occurs, in which discharged refrigerant flows back into the cylinder 133. As a result, the efficiency of the compressor 100 deteriorates.

SUMMARY OF THE INVENTION

Accordingly, it is an object of the present invention to provide a cylinder assembly of an improved hermetic compressor capable of decreasing the level of noise and vibration occurring during the operation of the compressor.

Another object is to provide a cylinder assembly of an improved hermetic compressor capable of reducing a number of parts and works in the manufacturing process.

Yet another object is to provide a cylinder assembly of an improved hermetic compressor capable of preventing the discharged refrigerant from flowing back into the cylinder by securing a fixed end of a discharge valve to a valve plate in a sealed manner.

The above objects are accomplished by a cylinder assembly of a hermetic compressor according to the present invention, including: a valve plate disposed on an outer side of a cylinder block to cover an open side of a cylinder. The valve plate having a refrigerant discharge hole therein through which a compressed refrigerant is discharged from the cylinder. A cylinder head covers the outer side of the valve plate and defines a refrigerant discharge chamber in cooperation with the valve plate. A discharge valve sheet is disposed between the valve plate and the cylinder head and includes a cantilevered discharge valve which is integrally formed therein by cutting a portion thereof, a center portion of which covers the refrigerant discharge hole of the valve plate. Integral with the cylinder head and gasket is a restricting mechanism comprising a first stopper member protruding from an inner wall of the cylinder head to a height where a terminal end of the first stopper member is at a predetermined distance from a leading end of the discharge valve, the restricting mechanism regulates movement of the discharge valve. When the refrigerant discharge hole is opened, the discharge valve is deformed such that the center portion bends while the leading end is moved within a limited range due to the first stopper member.

The restricting mechanism also comprises a second stopper member protruding from the inner wall of the cylinder head toward the center portion of the discharge valve, for regulating movement of the center portion of the discharge valve.

The first stopper member protrudes from the inner wall of the cylinder head toward the discharge valve by a distance greater than the second stopper member by a predetermined distance.

The restricting mechanism also comprises a third stopper member protruding from the inner wall of the cylinder head toward a fixed end of the discharge valve, to press the fixed end of the discharge valve onto the valve plate.

Further provided is a cylinder gasket disposed between the discharge valve sheet and the cylinder head, wherein the fixed end of the discharge valve is pressed to the valve plate as a part of the cylinder gasket is pressed by the third stopper member.

The valve plate, discharge valve sheet and the internal configuration of the cylinder head itself with their integral components in the present invention replace the valve plate and the separate discharge valve, keeper and stoppers of the prior art device which had to be formed separately and assembled to the valve plate by fastener S.

BRIEF DESCRIPTION OF THE DRAWINGS

The above-mentioned objects and the feature of the present invention will be more apparent by describing the preferred embodiment of the present invention in detail referring to the appended drawings, in which.

DETAILED DESCRIPTION OF THE PREFERRED EMBODIMENT

Figure 1:
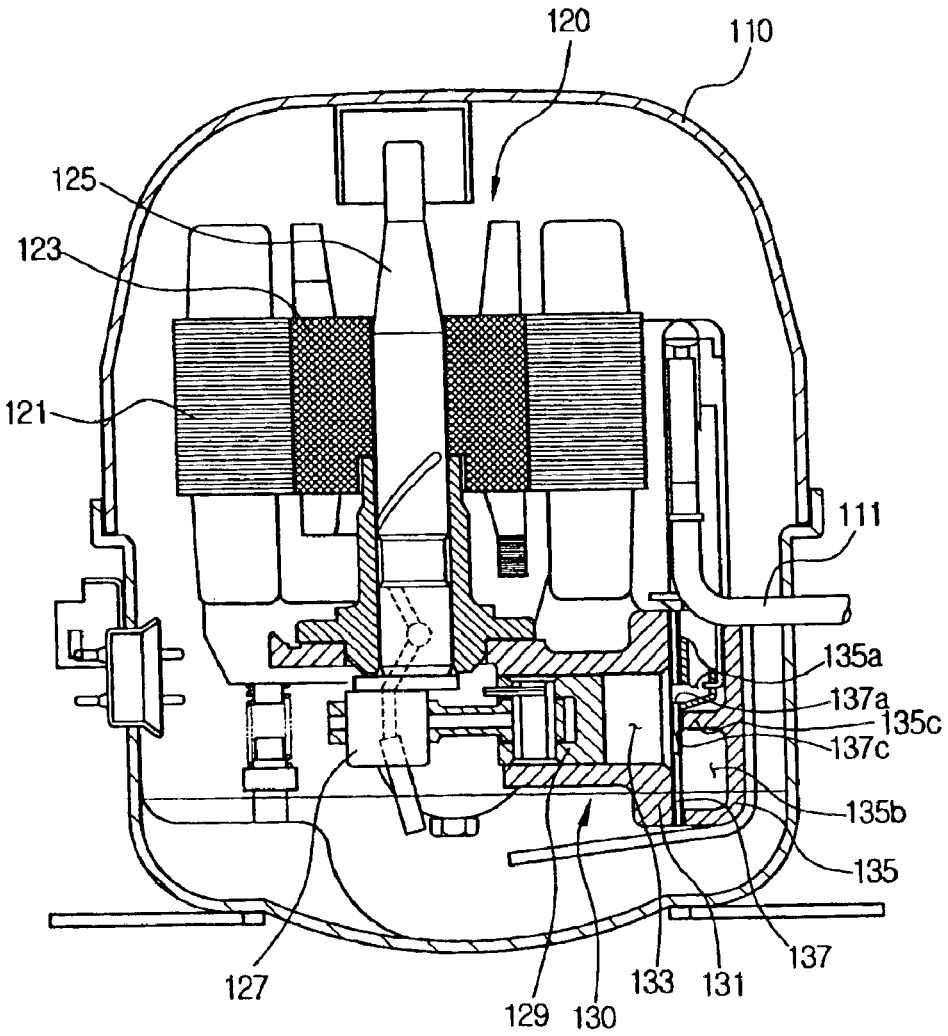
FIG. 1 (PRIOR ART)
FIG. 1 is a sectional view showing a conventional hermetic compressor.
Figure 2:
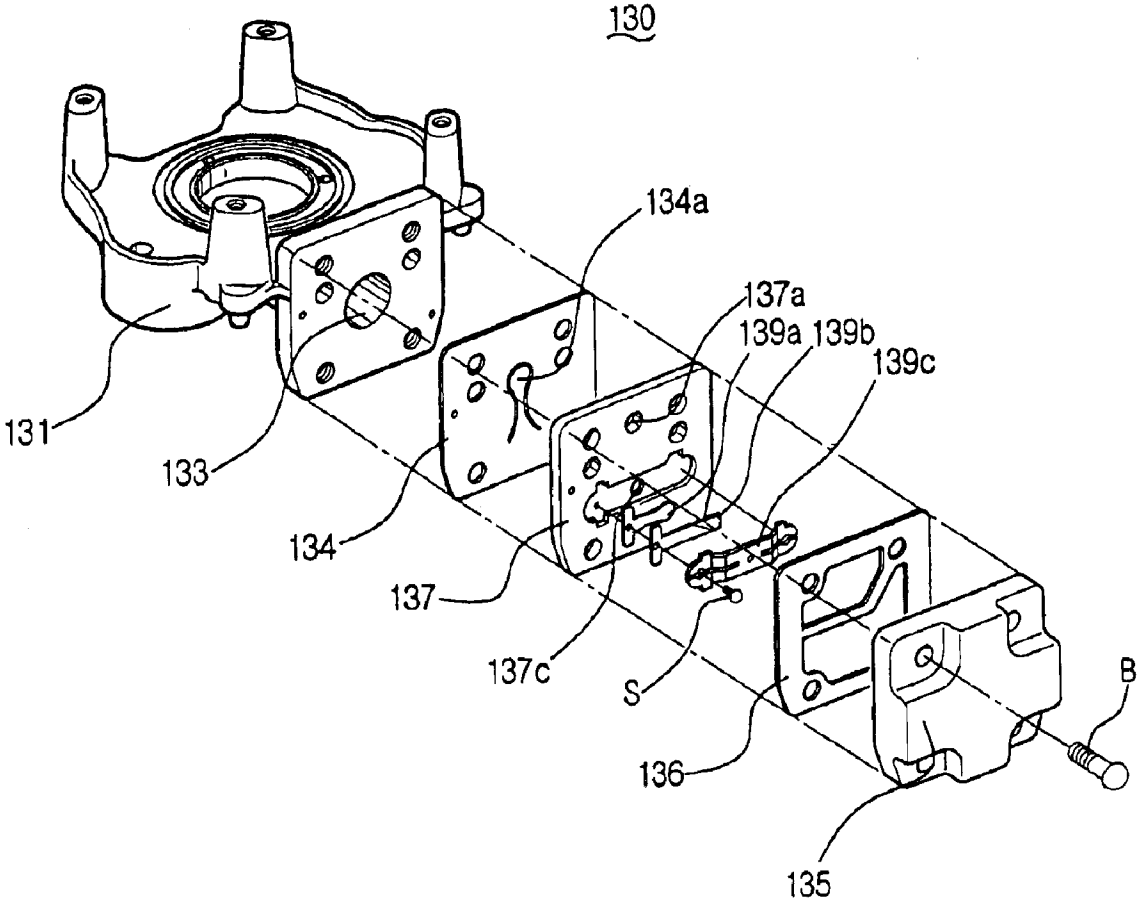
FIG.2 (PRIOR ART)
FIG. 2 is a perspective view showing the cylinder assembly of FIG. 1.
Figure 3:
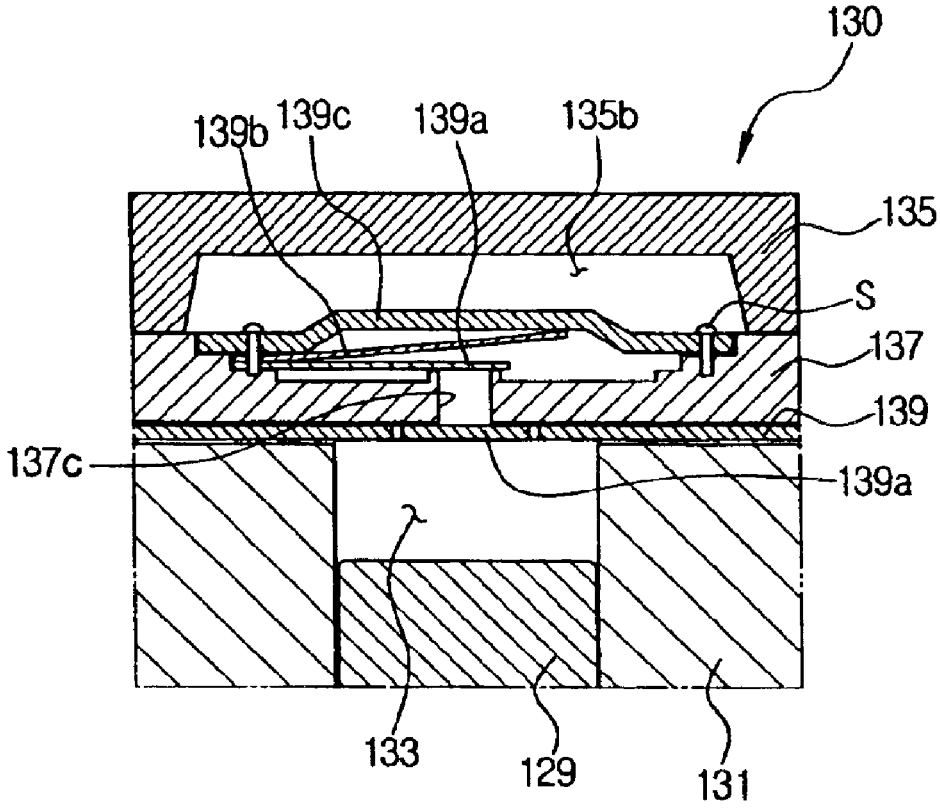
FIG.3 (PRIOR ART)
FIG. 3 is a sectional view showing the assembled cylinder assembly of FIG. 2 in operation.

The present invention will be described in greater detail with reference to the accompanying drawings. Throughout the description, like elements having similar construction and function to those in the prior art that has been described with reference to FIGS. 1 through 3 will be given the same reference numerals.

Figure 4:
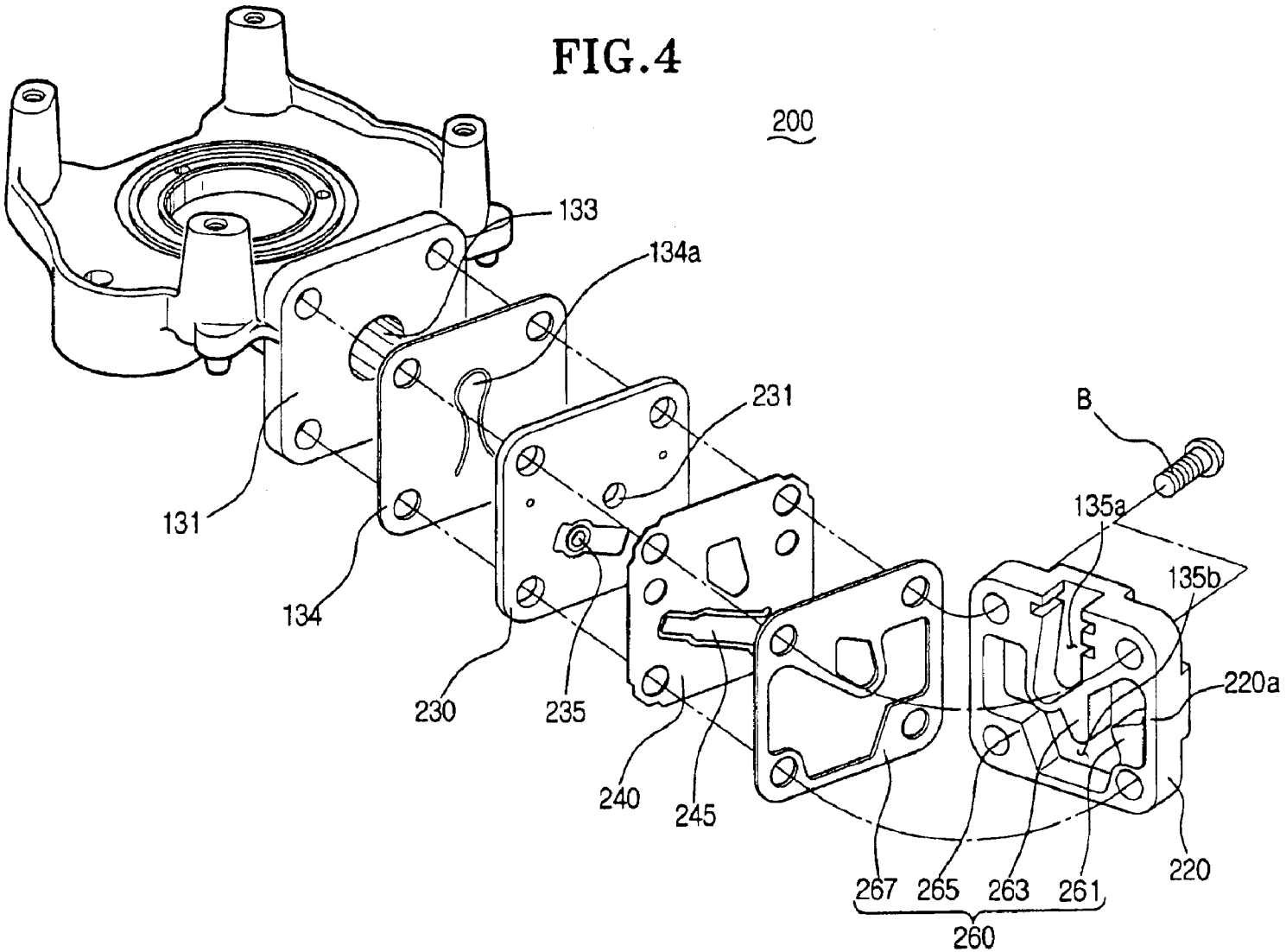
FIG. 4 is a perspective view showing a cylinder assembly of a hermetic compressor according to the present invention.
Figure 5:
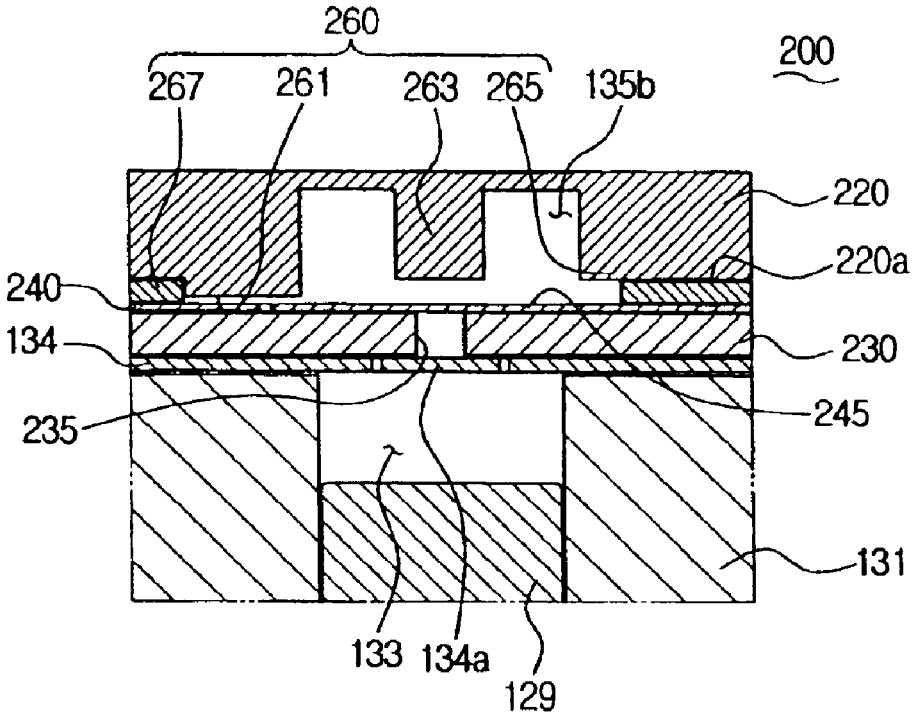
FIG. 5 is a sectional view showing the assembled cylinder assembly of FIG. 4 in operation.

Referring to FIGS. 4 and 5, a cylinder assembly 200 of the hermetic compressor 100 according to the present invention includes a cylinder block 131, a suction valve sheet 134, a valve plate 230, a discharge valve sheet 240, a cylinder gasket 267 and a cylinder head 220 The discharge valve sheet 240 includes a discharge valve 245 for resiliently moving to open and close the refrigerant discharge hole 235 formed in valve plate 230, and a plurality of stopper members 261, 263, 265 integrally formed with the cylinder head 220. The stopper members 261, 263, 265 serve as a restricting mechanism for restricting the range of movement of the discharge valve 245.

Valve plate 230 is disposed at an open side of the cylinder block 131, covering the cylinder 133. The valve plate 230 also includes a refrigerant suction hole 231 and a refrigerant discharge hole 235 in communication with the cylinder 133. The refrigerant suction hole 231 is opened as a leading end of the suction valve 134*a* is resiliently moved by the flow of refrigerant to the cylinder 133 during the reciprocal movement of the piston 129 (see FIG. 1). The suction valve 134*a* can be constructed in various ways. For example, as in the prior art, the suction valve 134*a* can be integrally formed with the suction valve sheet 134.

Between valve plate 230 and the cylinder head 220 are discharge valve sheet 240 and gasket 267. Through these components, cylinder head 220 is connected to the cylinder block 131 a side of the cylinder block 131, in a manner of covering the valve plate 230. The space defined between the valve plate 230 and the cylinder head 220 is partitioned into refrigerant suction chamber 135*a* and refrigerant discharge chamber 135*b*. The refrigerant suction chamber 135*a* is interconnected with the cylinder 133 through the refrigerant suction chamber 231, and the refrigerant discharge chamber 135*b* is interconnected with the cylinder 133 through the refrigerant discharge hole 235.

In operation, discharge valve 245 opens and closes refrigerant discharge hole 235 while being resiliently moved by the flow of refrigerant. Similar to the suction valve 134*a*, discharge valve 245 is formed by cutting a part of the discharge valve sheet 240 in the cantilevered pattern. Another description of discharge valve 245 is that it acts a leaf spring cut from discharge valve sheet 240 with a fixed end and a free end. The discharge valve sheet 240 is preferably formed in a plate shape, and can be mounted on the cylinder block 131 together with the cylinder head 220 and the valve plate 230 by a fastening means B such as a bolt. As there is no need to use a separate fastening member S (see FIG. 2) to mount the discharge valve 245, the number of parts and fasteners in the manufacturing process is thereby decreased. It is preferable that the width of the center of the discharge valve 245 is extended to be larger than the other parts so as to cover the refrigerant discharge hole 235 completely.

Discharge valve 245 is resiliently deformed during the discharge of the compressed refrigerant from the cylinder 133, thereby opening the refrigerant discharge hole 235. Such deformation of the discharge valve 245 is determined depending on the location of the refrigerant discharge hole 235 and the shape of the restricting means for restricting the movement of the discharge valve 245. In this embodiment, the discharge valve 245 is formed to cover the refrigerant discharge hole 235, so as to focus the pressure of discharged refrigerant through the refrigerant discharge hole 235 on the center portion of the discharge valve 245.

The restricting mechanism 260 includes first, second and third stopper members 261, 263, 265 protruding from an inner wall of the cylinder head 220 toward the discharge valve 245, and a cylinder gasket 267. The restricting mechanism 260 restricts and regulates the resilient movement of the discharge valve 245.

The first stopper member 261 protrudes from the inner wall of the cylinder head 220 toward the proximity of the leading end of the discharge valve 245. Accordingly, the leading end of the discharge valve 245 is set within a predetermined movement range.

The second stopper member 263 protrudes from the inner wall of the cylinder head 220 toward the center portion of the discharge valve 245 (i.e., toward the refrigerant discharge hole 235), with a length shorter than the length of the first stopper member 261. The third stopper member 265 protrudes from the inner wall of the cylinder head 220 toward the fixed end of the discharge valve 245.

According to the preferred embodiment, second and third stopper members 263, 265 protrude from the inner wall to the same height as the outline 220*a* of the cylinder head 220, while the first stopper member 261 protrudes toward the discharge valve 245 to beyond the outline 220*a* of the cylinder head 220. The second stopper member 263 and the center portion of the discharge valve 245 are spaced away from each other by a predetermined distance, so as to avoid contact with each other. In other words, it is preferable that the second stopper member 263 is formed with a length that allows the contact of the terminal end of the second stopper member 263 to contact with the discharge valve 245 only when the discharge valve 245 is abnormally in excessive movement.

The stopper members 261, 263, 265 are integrally formed with the cylinder head during the molding of cylinder head 220. Although the stopper members 261, 263, 265 are depicted as protruding toward the discharge valve 245 in this embodiment, this should not be considered as limiting. Various modifications are possible, provided that the ends of the stopper members 261, 263, 265 are maintained at a predetermined distance from the corresponding portion of the discharging valve 245.

Meanwhile, the cylinder head 220 is not allowed to come into close contact with valve plate 230 due to the presence of the first stopper member 261 which protrudes beyond the outline 220*a* of the cylinder head 220. Through a gap defined between the valve plate 230 and the cylinder head 220, refrigerant can leak out of the cylinder assembly 200 during the suctioning/discharging process. In order to prevent such refrigerant leakage, the cylinder gasket 267 is disposed between the cylinder head 220 and the valve plate 230 thereby eliminating any back flow problems.

The cylinder gasket 267 has the identical shape as the section of the outline 220*a* of the cylinder head 220, which is the shape of a square frame. A part of the cylinder gasket 267 is formed into the shape that can press the fixed end of the discharge valve 245 by the third stopper member 265 during the assembling of the cylinder assembly 200. More specifically, as the part of the cylinder gasket 267 is pressed to the terminal end of the third stopper member 265 in a state that the cylinder assembly 200 is completely assembled, the fixed end of the discharge valve 245 is made to come into the close contact with the valve plate 230. Accordingly, the discharge valve 245 can completely cover the refrigerant discharge hole 235 after the discharge of refrigerant, and thus can prevent the refrigerant of the refrigerant discharge chamber 135*b* from leaking into the cylinder 133. The thickness of the cylinder gasket 267 is greater than the distance between the outline 220*a* and the first stopper member 261.

According to the preferred embodiment, the thickness of the cylinder gasket 267 is 0.5 mm, and the first stopper member 261 protrudes toward the discharge valve 245, exceeding the outline 220*a* of the cylinder head 220 by 0.4 mm. Accordingly, in the cylinder assembly 200 being assembled, the distance between the first stopper member 261 and the leading end of the discharge valve 245 is 0.1 mm, and the distance between the terminal end of the second stopper member 263 and the center portion of the discharge valve 245 is 0.5 mm. Meanwhile, the fixed end of the discharge valve 245 is pressed toward the valve plate 230 by the third stopper member 265 and the cylinder gasket 267.

The operation of the discharge valve 245 during the refrigerant discharge will be described below with reference to FIG. 6.

As the pressure grows in the cylinder 133 in which the refrigerant is compressed, the center portion of the discharge valve 245 starts to bend, and accordingly, the free end of the discharge valve 245 is subjected to a force to be raised up. However, because the free end of the discharge valve 245 is restricted in its movement by the terminal end or edge of the first stopper member 261, only the center portion of the discharge valve 245 deforms upward. Accordingly, since the leading end of the discharge valve 245 contacts first stopper member 261 during the beginnings of the opening of the refrigerant discharge hole 235, when the movement of the discharge valve 245 is relatively less than the other times, noise and vibration can be effectively reduced. The volume of noise and vibration can also be effectively counterbalanced even when the discharge valve 245 is excessively open so as to contact the second stopper member 263 due to abnormal discharge of the refrigerant. This is because the leading end of the discharge valve 245 and the first stopper member 261 will already be in contact with each other and thus any noise or vibration will be lessened sufficiently.

Figure 6:
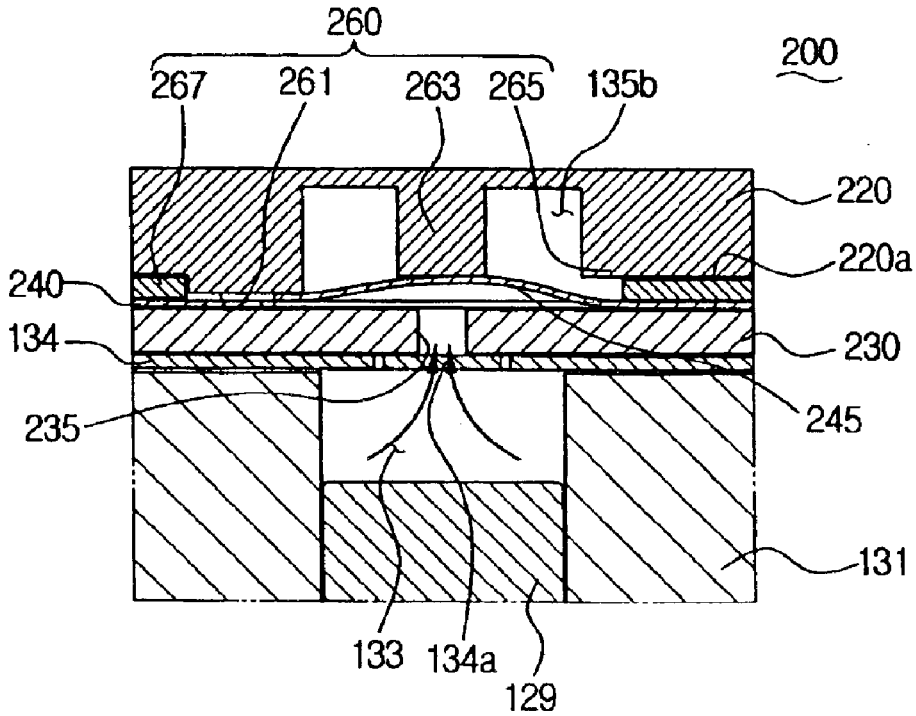
FIG. 6 is a sectional view showing the assembled cylinder assembly of FIG. 5 operating according to a preferred embodiment of the present invention.

As best seen in FIG. 6, stopper members 261, 263 and 265 protrude from the interior of cylinder head 220 at two different distances. Stopper member 261 protrudes the farthest, to thereby bear against the free end of discharge valve 245. Central stopper member 263 protrudes a shorter distance to ensure that the central portion of discharge valve 245 does not deform upward farther than desired by the design of the assembly. Finally, stopper member 265 protrudes from the cylinder head the same distance as stopper member 263 to bear upon the fixed end of discharge valve 245 and gasket 267 in the assembly.

While describing the stopper members 261, 263, 265 integrally formed with the cylinder head 220, the preferred embodiment depicted the stopper member 261, 263, 265 as being protruded out of the cylinder head 220. However, this should not be considered as limiting. For example, while first and second stopper members 261, 263 are disposed inside of the cylinder head 220 so as not to expose the terminal end of the first stopper member 261 to the outside of the cylinder head 220, the first stopper member 261 can be formed longer than the second stopper member 263. This alternative has no degradation of effect. Depending on circumstances, the second stopper member 263 can be omitted, while still preserving the same movement of the discharge valve 245.

According to the present invention constructed as above, according to the location of the discharge valve 245 and by the restricting means 260, the discharge valve 245 is formed such that the center portion bends up to open the refrigerant discharge hole 235 during the refrigerant discharge. Accordingly, the leading end of the discharge valve 245 is contacted with and distanced from the first stopper member 261 within a narrower movement width, and as a result, noise and vibration generated during the movement of the discharge valve 245 can be counterbalanced effectively.

Further, as the movement range of the free end of the discharge valve 245 is limited by the first stopper member 261, vibration of the free end of the discharge valve 245 during the refrigerant discharge can be prevented. As a result, noise and vibration can be reduced.

Further, by pressing the fixed end of the discharge valve 245 to the valve plate 230 with the cylinder gasket 267 and the cylinder head 220, the discharge valve 245 is contacted with the valve plate 230 tightly. As a result, the back flow phenomenon, in which the refrigerant of the refrigerant discharge chamber 135*b* leaks back to the cylinder 133, can be prevented.

Further, as the movement of the discharge valve 245 is restricted by the stopper members 261, 263, 265 which are integrally formed on the cylinder head 220 during the molding of the cylinder head 220, use of separate parts such as stopper member 139*b* or keeper plate 139*c* can be omitted. Accordingly, the number of parts and assembly steps in the manufacturing process of the compressor 100 is reduced greatly, and as a result, manufacturing costs decrease, while more compact-sized compressor 100 can be developed. In addition, since four discrete components of the prior art assembly, the separately formed discharge valve, stopper, keeper and the fastener S, are now integrated into a single discharge valve sheet 240 and the configuration of the cylinder head itself, assembly is greatly simplified. Furthermore, discharge valve sheet 240 has substantially the same outline shape as the other components and includes the blind holes in the four corners which align with the corresponding holes of the other components to assemble easily onto cylinder block 131. Assembly may be more entirely automated than with the prior art embodiment.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A cylinder assembly of a hermetic compressor, comprising:

a valve plate disposed on an outer side of a cylinder block to cover an open end of a cylinder, said valve plate having a refrigerant discharge hole therethrough adapted to discharge a compressed refrigerant from the cylinder;

a cylinder head disposed to cover an outer side of said valve plate, said cylinder head defining a refrigerant discharge chamber in cooperation with said valve plate;

a discharge valve disposed between said valve plate and said cylinder head in a cantilever manner, a center portion of said discharge valve covering said refrigerant discharge hole; and said cylinder head comprising a restricting mechanism comprising an integral first stopper member protruding from an inner wall of said cylinder head a distance such that a terminal end of said first stopper member is at a predetermined distance from a leading end of said discharge valve, said restricting mechanism for restricting a movement of said discharge valve, wherein during operation and opening of said refrigerant discharge hole, said discharge valve is deformed such that a center portion thereof deforms toward said cylinder head while the leading end is moved within a limited range due to said first stopper member impinging on said discharge valve.

2. The cylinder assembly of claim 1, wherein said discharge valve is integrally formed with a discharge valve sheet which is disposed between said valve plate and said cylinder head, by cutting a portion of said discharge valve sheet to form a flexible valve member.

3. The cylinder assembly of claim 2, wherein said restricting mechanism comprises a second integral stopper member protruding from the inner wall of said cylinder head toward the center portion of said discharge valve for restricting movement of the center portion of said discharge valve in a limited range.

4. The cylinder assembly of claim 3, wherein said first stopper member protrudes from the inner wall of said cylinder head toward said discharge valve a distance greater than said second stopper member by a predetermined distance.

5. The cylinder assembly of claim 2, wherein said restricting mechanism comprises a third integral stopper member protruding from the inner wall of said cylinder head toward a fixed end of said discharge valve, to press said fixed end of said discharge valve onto said valve plate.

6. The cylinder assembly of claim 5, further comprising a cylinder gasket disposed between said discharge valve sheet and said cylinder head, wherein the fixed end of said discharge valve is pressed to said valve plate as a part of said cylinder gasket is pressed by said third stopper member.

7. A cylinder head assembly for a cylinder block of a hermetic compressor comprising:

a cylinder head having a refrigerant discharge chamber covering said cylinder block and aligned therewith to define an inner direction toward said cylinder block and an outer direction toward said cylinder head;

a valve plate disposed between said cylinder block and said cylinder head, said valve plate having a refrigerant discharge hole integrally formed therethrough;

a discharge valve sheet disposed between said valve sheet and said cylinder head, said discharge valve sheet having an integrally formed, resiliently flexible discharge valve having a free end and a fixed end, said discharge valve aligned with said discharge hole of said valve plate;

said cylinder head, valve plate and discharge valve sheet are all sized and configured to be aligned and fastened together and to said cylinder block by a single fastening mechanism;

wherein said cylinder head includes an inner configuration comprising a refrigerant discharge chamber generally aligned with said discharge valve, and an integral restricting mechanism to limit movement of said discharge valve when the compressor is in operation and refrigerant is discharged from the cylinder block, said integral restricting mechanism comprising a first stopper member integrally protruding from the inner side of said cylinder head and aligned with the free end of said discharge valve and bearing thereagainst when assembled to limit movement of the free end when refrigerant is discharged through said discharge hole covered by said discharge valve, and a second stopper member integrally protruding from the inner side of said cylinder head a distance less than said first stopper member, said second stopper member being aligned with a central portion of said discharge valve so as to limit deformation of said discharge valve in its central portion.

8. The assembly of claim 7, wherein said integral restricting mechanism further comprises a third stopper member integrally protruding from the inner side of said cylinder head a distance equal to that of said second stopper member, said third stopper member being aligned with the fixed end of said discharge valve so as to bear thereagainst when assembled.

9. The assembly of claim 7, wherein said integral restricting mechanism comprises a central stopper member integrally protruding from the inner side of said cylinder head a predetermined distance and aligned with a central portion of said discharge valve to limit deformation of the central portion of said discharge valve.

10. The assembly of claim 7, wherein said integral restricting mechanism comprises a stopper member integrally protruding from the inner side of said cylinder head a predetermined distance and aligned with the fixed end of said discharge valve to bear thereagainst when assembled.

11. The assembly of claim 7, wherein said discharge valve is integrally formed with said discharge valve sheet by cutting a portion of said discharge valve sheet to form a flexible valve member.

12. The assembly of claim 7, further comprising a cylinder gasket disposed between said discharge valve sheet and said cylinder head to seal said assembly.

13. The assembly of claim 8, further comprising a cylinder gasket disposed between said discharge valve sheet and said cylinder head to seal said assembly, whereby the fixed end of said discharge valve is pressed against said valve plate as a portion of said cylinder gasket is pressed by said third stopper member.

* * * * *